United States Patent [19]

Jacobsen

[11] 4,070,309

[45] Jan. 24, 1978

[54] DETERGENT COMPOSITION

[75] Inventor: Ronald Lowell Jacobsen, Cincinnati, Ohio

[73] Assignee: The Procter & Gamble Company, Cincinnati, Ohio

[21] Appl. No.: 709,015

[22] Filed: July 27, 1976

[51] Int. Cl.[2] ..... C11D 3/36

[52] U.S. Cl. ..... 252/547; 252/89 R; 252/544; 252/548; 252/550; 252/551; 252/554; 252/555; 252/558; 252/DIG. 14; 252/DIG. 17

[58] Field of Search ..... 252/525, 528, 529, 531, 252/532, 535, 536, 539, 544, 547, 548, 550, 551, 554, 555, 558, 89 R, DIG. 14, DIG. 15, DIG. 17

[56] References Cited

U.S. PATENT DOCUMENTS

| | | | |
|---|---|---|---|
| 3,351,558 | 11/1967 | Zimmerer | 252/532 X |
| 3,624,006 | 11/1971 | Karg | 252/DIG. 17 X |
| 3,956,199 | 5/1976 | Dawson et al. | 252/DIG. 17 X |
| 3,963,635 | 6/1976 | Dawson et al. | 252/558 X |

FOREIGN PATENT DOCUMENTS

| | | |
|---|---|---|
| 7,207,017 | 11/1972 | Netherlands. |
| 1,315,363 | 5/1973 | United Kingdom. |
| 1,395,031 | 5/1975 | United Kingdom. |

*Primary Examiner*—Harris A. Pitlick
*Attorney, Agent, or Firm*—Robert B. Aylor; Thomas H. O'Flaherty; Richard C. Witte

[57] ABSTRACT

Light duty, anionic detergent compositions containing a phosphorus surfactant detergency boosting ingredient which improves the removal of baked on and hard-to-remove soils from housewares, including pots and pans, dishes, glasses, utensils, etc. Process for washing dishes with said compositions. Process for the preparation of said compositions.

11 Claims, No Drawings

DETERGENT COMPOSITION

BACKGROUND OF THE INVENTION

The present invention relates to light-duty, anionic liquid detergent compositions. Such compositions contain anionic surfactants; normally, a suds boosting ingredient; the phosphorus surfactant; perfume; and an aqueous solvent. They may also contain minor ingredients and a minor amount of conventional detergent builders and have a pH which is neutral or slightly alkaline.

Numerous examples of such light duty liquid detergent compositions can be found in the art including U.S. Pat. Nos. 3,332,874; 3,332,877; 3,332,879; 2,970,964; 2,970,963; 3,179,599; 3,179,598; 3,211,661; and 3,793,233, said patents being incorporated herein by reference. Similar compositions are disclosed in the copending U.S. Pat. application, Ser. No. 669,531, filed Mar. 23, 1976 of Hellyer et al, entitled, "DETERGENT COMPOSITIONS CONTAINING SEMIPOLAR NONIONIC DETERGENT AND ALKALINE EARTH METAL ANIONIC DETERGENTS", said application being incorporated herein by reference. The present invention relates to improvements of the light duty liquid detergent compositions disclosed in the aforementioned patents and application. Although such light duty liquid compositions are excellent for the intended purpose, the present invention constitutes an improvement on such compositions.

Many previous attempts have been made to improve the cleaning ability of light duty liquid compositions of the type contemplated herein. For example, U.S. Pat. No. 3,956,199 discloses light duty liquid detergent compositions containing from 0.015 to 0.45 percent of an organic phosphonate which is said to provide anti-resoiling affects on aluminum. Similar disclosures can be found in Belgain Pat. No. 767,887 and South African Patent Application No. 71/3410 which disclose the use of phosphonates and phosphates of fatty alcohols, alkyl phenols, ethoxylated fatty alcohols, etc. in acidic detergent compositions, the low pH being considered essential to the provision of anti-resoiling characteristics on aluminum.

SUMMARY OF THE INVENTION

The present invention relates to a light duty liquid detergent composition consisting essentially of a. from about 5% to about 35% of an anionic surfactant having the formula $$R—(Y)_n—(O)_nSO_3M$$

wherein R is an alkyl group containing from about 8 to about 24 carbon atoms which can be either straight or branched chain, saturated or unsaturated and attached either at the terminal position, a secondary position, or random attachment or mixtures thereof; Y is a group selected from the group consisting of $(OC_2H_4)_x$ wherein x is a number from 1 to 30; $(O—CH_2—CHOH—CH_2)_m$ wherein m is a number from 1 to 3; or a benzene ring; each n is either 0 or 1; and M is selected from the group consisting essentially of sodium; potassium; mono-, di-, or tri-alkanolammonium wherein the alkanol groups contain from 2 to 4 carbon atoms; mono-, di-, or tri-alkylammonium wherein the alkyl groups contain from 2 to 4 carbon atoms; ammonium; magnesium; calcium; or mixtures thereof;

b. from 0% to about 15% of a suds boosting ingredient selected from the group consisting of amine oxide surfactants and amide surfactants;

c. from 0.5% to about 10% of a detergency boosting ingredient selected from the group consisting of compounds having the formula

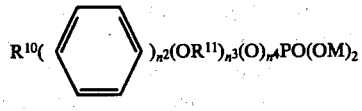

wherein $R^{10}$ is an alkyl group containing from about 14 to about 20 carbon atoms, wherein $R^{11}$ is an alkylene group containing 2 or 3 carbon atoms, wherein $n^2$ is 0 or 1, wherein $n^3$ is a number from 0 to about 20, wherein $n^4$ is 0 or 1, wherein $M_2$ is a cation selected from the group consisting of hydrogen; sodium; potassium; ammonium; mono-, di-, and tri-alkanolammonium; mono-, di-, or tri-alkylammonium; magnesium; calcium; and mixtures thereof, $R^{10}$ being a random alkyl group when $n^2$, $n^3$ and $n^4$ are 0;

d. from 0% to about 20% of a detergency builder; and, e. water, the pH of the composition being above 7 and less than about 10.

DETAILED DESCRIPTION OF THE INVENTION

The individual components of the instant detergent compositions are described in detail below.

THE ANIONIC SURFACTANT

The anionic synthetic non-soap detergents utilized herein can be broadly described as the water soluble salts, particularly the alkali metal salts of organic sulfuric acid reaction products having in their molecular structure an alkyl radical containing from about 8 to about 20 carbon atoms and a radical selected from the group consisting of sulfonic acid and sulfuric acid ester radicals. Specific examples include the sodium or potassium alkyl sulfates obtained by sulfating the higher alcohols ($C_8$–$C_{18}$ carbon atoms) produced by reducing the glycerides of tallow or coconut oil, sodium or potassium alkyl benzene sulfonates in which the alkyl group can be a straight or branched chain which contains from about 9 to about 15 carbon atoms in the alkyl group; sodium alkyl glyceryl ether sulfonates, especially those ethers of the higher alcohols derived from tallow and coconut oil; the sodium or potassium salts of sulfuric acid esters of the reaction products of one mole of a higher fatty alcohol (e.g., tallow or coconut oil alcohols) and from one to 30 moles of ethylene oxide. Other suitable anionic surfactants include olefin sulfonates having from about 12 to about 24 carbon atoms. The term "olefin sulfonate" is used here to mean compounds which can be produced by the sulfonation of alpha-olefins and is by means of uncomplexed sulfur trioxide followed by neutralization of the acid reaction mixture using conditions such that the sultones which have been formed in the reaction are hydrolyzed to give the corresponding hydroxyalkylene sulfonates. The sulfur trioxide may be liquid or gaseous and is usually, but not necessarily, diluted by inert diluents, for example by liquid $SO_2$, chlorinated hydrocarbon, etc. when used in the liquid form, or by air, nitrogen, gaseous $SO_2$, etc. when used in the gaseous form. Alpha olefins which can be used include 1-dodecene, 1-tetradecene, 1-hexadecene, etc. Other suitable anionic surfactants include paraffin sulfonats containing from 8 to 18 carbon atoms. Preferred mixtures are those described in the U.S. Patents and Patent Application referred to hereinbefore and incorporated herein by reference. The anionic surfactants provide the main detergency benefit for these compositions and are responsible for the good sudsing characteristics of these compositions. Preferably the compositions will contain from about 10 to about 30 percent of the anionic surfactant, most preferably from about 15 to about 30 percent by weight of the surfactant. All parts, ratios, percentages, etc. herein are by weight unless otherwise specified.

THE NONIONIC SUDS BOOSTER

The nonionic suds boosters of this invention include semi-polar, nonionic detergents such as the tertiary amine oxides corresponding to the general formula $$R^1—(OR^2)_{n'}—N(R^3)_2 \rightarrow O$$

in which $R^1$ is an alkyl radical of from about 8 to about 18 carbon atoms; $R^2$ is an alkylene or a hydroxy alkylene group containing 2 to 3 carbon atoms; $n^1$ ranges from 0 to about 20; and each $R^3$ is selected from the group consisting of methyl, ethyl and hydroxyethyl radicals and mixtures thereof. The arrow in the formula is a conventional representation of a semi-polar bond. Specific examples of amine oxide detergents include dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldiethylamine oxide, tetradecyldiethylamine oxide, hexadecyldiethylamine oxide, octadecyldiethylamine oxide, dodecyldipropylamine oxide, tetradecyldipropylamine oxide, hexadecyldipropylamine oxide, octadecyldipropylamine oxide, dodecyldibutylamine oxide, tetradecyldibutylamine oxide, octadecyldibutylamine oxide, bis(2-hydroxyethyl) dodecylamine oxide, bis-(2-hydroxyethyl)-3-dodecoxy-1-hydroxypropylamine oxide, (2-hydroxypropyl) methyltetradecylamine oxide, dimethyl-(2-hydroxydodecyl)amine oxide, 3,6,9-trioxaoctadecyl dimethylamine oxide and 3-dodecoxy-2-hydroxy propyl di(2-hydroxyethyl-)amine oxide.

Another suds boosting nonionic surfactant is an organic carboxylic acid amide.

Such amide compounds include those aliphatic amides of the general formula:

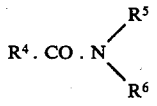

wherein $R^4$ is hydrogen, alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25.

Amides of this general type which are of special utility are those aliphatic carboxylic acid alkanolamides of the formula:

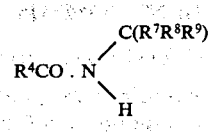

in which RCO is the acyl group of a soap-forming carboxylic acid having from about 10 to about 18 carbon atoms, $R^7$ and $R^8$ are each selected from the group consisting of hydrogen, $C_1$–$C_2$ alkyl, and $C_0$–$C_2$ alkylol substituents, and $R^9$ is an alkylol substituent, the total number of carbon atoms in $R^7$, $R^8$ and $R^9$ being from 1 to 7.

Some specific amides coming within the scope of the invention are:

lauric ethanolamide;
stearic ethanolamide;
dimethyl lauramide;
lauramide;
lauryl lauramide;
myristic N-methyl ethanolamide;
butyl capramide;
capric butanolamide;
dibutyl capramide;
dibutyl myristamide;
stearic acid amide of tris(hydroxymethyl)amino methane;
myristic glycerylamide;
N-lauroyl morpholine;
lauric glycerylamide;
palmitic acid amide of 2-amino-2-methyl-1,3-propanediol;
lauryl hydroxy-acetamide;
myristyl formamide;
lauric isopropanol amide; and
myristic acid amide of 3-amino-3-methyl-2,4-pentanediol.

Especially preferred is tallow acyl monoethanolamide.

Such amides, and their preparation are discussed more fully in U.S. Pat. No. 2,527,076, hereby incorporated by reference.

Preferred amounts of nonionic suds booster are from about 3% to about 7%.

THE DETERGENCY BOOSTING INGREDIENT

Preferably the detergency improver is selected from the group consisting of random alkyl phosphonates wherein the alkyl group contains from 14 to about 20 carbon atoms and terminal alkyl phosphates wherein the alkyl group contains from about 14 to about 20 carbon atoms in the form of their sodium; potassium; ammonium; mono-, di-, or tri-alkanolammonium; mono-, di-, tri-alkylammonium; magnesium; and calcium salts and mixtures thereof.

The detergency boosting ingredient can be either a random alkyl phosphonate or a terminal alkyl phosphate. The random alkyl phosphonate should preferably have from 14 to 20 carbon atoms, most preferably from 16 to 18 carbon atoms. Similarly the terminal alkyl phosphate should preferably contain from 14 to 20 carbon atoms, most preferably from 16 to 18 carbon atoms. The cation associated with these materials will normally be sodium or potassium, however, it may be ammonium, alkanolammonium, or alkyl ammonium as disclosed hereinbefore. The cation may also be magnesium or calcium so long as the compound is soluble in the formula.

The phosphonates and phosphates have been disclosed before.

The amount of the detergency boosting ingredient is from 0.5% to about 10% in the formula, preferably more than 0.7% and most preferably from 1% to about 5%. It has surprisingly been discovered that despite the teachings of the prior art, there is a distinct advantage in using higher levels of the detergency boosting ingredient in a composition intended for washing housewares such as pots, pans, utensils, glasses, dishes, etc. where "hard-to-remove" baked-on soils are commonly encountered. Contrary to the teachings of the prior art, the benefit at alkaline pH's and at the higher levels of the detergency improving ingredient is not merely the prevention of resoiling, but rather is a removal benefit which can be readily seen on the initial use. The advantage is essentially independent of pH with a slight improvement being noted for higher pH's. This is advantageous since higher pH's provide greater stability and better sudsing in anionic detergent compositions. Furthermore, the higher pH's tend to stabilize certain of the ingredients which may be used such as amides and esters which would tend to hydrolyze in acidic medium. Each of the types of detergency boosting ingredients has its own advantages. The random phosphonates are extremely effective and will provide a certain amount of corrosion inhibition. The alkyl phosphates are less effective but can be used to modify the sudsing characteristics if that is desired.

In order to incorporate the detergency boosting ingredients, especially the phosphonate, it is necesssary to add it at a pH of from about 9 to about 12.5.

THE MINOR INGREDIENTS

In addition to the main ingredients, it may be also desirable to have an organic water soluble solvent present such as an alcohol or glycol containing from 2 to about 4 carbon atoms or glycerine in an amount of from about 1% to about 15%, preferably from about 3% to about 10%. These solvents help to compatibilize the other organic ingredients when the other ingredients are present at higher levels.

It may also be desirable to include coloring agents, opacifiers, perfumes, corrosion inhibitors and small amounts of heavy metal chelating agents such as citric acid salts, ethylenediaminetetracetic acid salts, etc.

The pH of the composition is desirably above 7, e.g., from about 7.2 to about 9. Although higher pH's can be used, they tend to be more likely to damage the skin. The following examples demonstrate this invention.

Preferably the compositions of this invention do not contain calcium or magnesium since they cause some difficulties in providing a stable single-phase system.

The compositions can also contain small amounts, less than about 20%, preferably less than about 10%, of detergency builders. Normally such builders will not be present. Desirable builders include citrates, carbonates, orthophosphates, and pyrophosphates. Preferably the compositions do not contain phosphate builders. Other suitable builders are disclosed in U.S. Pat. Nos. 3,932,316 and 3,929,678, incorporated herein by reference.

The compositions of this invention are normally used in water at levels of from about 0.1% to about 0.5% to remove "hard-to-remove" soils from housewares.

EXAMPLE I

| Composition | 1 | 2 | 3 | 4 | 5 | 6 | 7 | 8 |
|---|---|---|---|---|---|---|---|---|
| Sodium coconut alkyl sulfate | 11.5 | 11.5 | 11.5 | 11.5 | 11.5 | 11.5 | 11.5 | 11.5 |
| Sodium coconut alkyl polyethoxylate (3) sulfate | 12.5 | 12.5 | 12.5 | 12.5 | 12.5 | 12.5 | 12.5 | 12.5 |
| Coconutalkyldimethylamine oxide | 4.0 | 4.0 | 4.0 | 4.0 | 4.0 | 4.0 | 4.0 | 4.0 |
| Potassium chloride | 1.0 | 1.0 | 1.0 | 1.0 | 1.0 | 1.0 | 1.0 | 1.0 |
| Sodium citrate | 0.2 | 0.2 | 0.2 | 0.2 | 0.2 | 0.2 | 0.2 | 0.2 |
| Ethanol | 7.0 | 7.0 | 7.0 | 7.0 | 7.0 | 7.0 | 7.0 | 7.0 |
| Potassium toluene sulfonate | 2.0 | 2.0 | 2.0 | 2.0 | 2.0 | 2.0 | 2.0 | 2.0 |
| Hydrogen peroxide | 0.01 | 0.01 | 0.01 | 0.01 | 0.01 | 0.01 | 0.01 | 0.01 |
| Perfume | 0.3 | 0.3 | 0.3 | 0.3 | 0.3 | 0.3 | 0.3 | 0.3 |
| $H_2SO_4$ | ← trim → | | | | | | | |
| Sodium random n-octadecane phosphonate | 0 | 1 | 3 | 1 | 3 | 1 | 3 | 0 |
| Sodium alkyl ($C_{12}$ – $C_{13}$) phosphate | 0 | 0 | 0 | 0 | 0 | 0 | 0 | 1 |
| Water | ← balance → | | | | | | | |
| pH | 8 | 8 | 8 | 7.5 | 7.5 | 5 | 5 | 8 |

The above compositions were tested as follows. Aluminum, which was 20–24 gauge, was cut into 2 inch by 4 inch coupons, 1/32 inch thick, and coated with four different soils. The first soil was prepared by blending 90 grams of lean ground beef with 200 milliliters of 70° F distilled water, pureeing in a blender for 60 seconds, then adding one egg to the slurry, whipping in the blender for 30 seconds, then adding 57 grams of Hunts Tomato Sauce to the slurry, mixing in the blender for 30 seconds, adding 50 grams of flour to the slurry, and pureeing in the blender for 20 minutes (beef soil). The second soil was macaroni and cheese prepared by emptying the contents of a Franco American Macaroni and Cheese can into a blender and pureeing for five minutes. The third soil was prepared by soft boiling eggs for three minutes, separating the egg yoke from the white, adding salt and pepper and stirring gently. The fourth soil was prepared by mixing ⅓ cup of Mother's Oats into ¾ cup boiling water, cooking for one minute, adding ½ cup milk and pureeing in a blender for one minute. The above four soils were applied with a roller to the aluminum coupons and the coupons were baked for 20 minutes at 400° F. The coupons were then removed and allowed to cool for at least 20 minutes.

The coupons were cleaned by the following method. A detergent solution containing 0.2% product concentration was prepared using one gallon of 110° F city water in a Rubber Maid dish pan. The soiled coupons were placed in a rack and immersed in the solution for five minutes. A standard dish cloth was folded in half four times. The coupons were then wiped until all the soil had been removed, applying even pressure to all areas of the coupon. The number of wipes required to clean the entire coupon were noted (one wipe is a down and up stroke on the coupon). Three replicates of each test were made. The three replicates are averaged for the number of wipes to remove all soil. The results were as follows.

| Composition | 1 | 2 | 3 | 4 | 5 | 6 | 7 | 8 |
|---|---|---|---|---|---|---|---|---|
| Beef Soil | 21 | 12 | 8 | 12 | 9 | 15 | 8 | 14 |
| Macaroni and Cheese | 20 | 11 | 8 | 10 | 8 | 14 | 9 | 15 |
| Egg | 18 | 10 | 7 | 11 | 9 | 12 | 8 | 13 |
| Oatmeal | 20 | 11 | 8 | 11 | 9 | 14 | 8 | 14 |

As can be seen from the above table, the compositions which contain the detergency improving compounds remove the soils better and more readily than the same composition without the detergency improving materials. Higher pH's provide an improved benefit with the lower concentrations of the detergency improving material.

EXAMPLE II

| Composition | 1 | 2 | 3 | 4 | 5 | 6 |
|---|---|---|---|---|---|---|
| Sodium coconut alkyl sulfate | 11.5 | 11.5 | 11.5 | 11.5 | 11.5 | 11.5 |
| Sodium coconut alkyl polyethoxylate (3) sulfate | 12.5 | 12.5 | 12.5 | 12.5 | 12.5 | 12.5 |
| Coconut alkyl dimethyl amine oxide | 4.0 | 4.0 | 4.0 | 4.0 | 4.0 | 4.0 |
| Potassium chloride | 1.0 | 1.0 | 1.0 | 1.0 | 1.0 | 1.0 |
| Sodium citrate | 0.2 | 0.2 | 0.2 | 0.2 | 0.2 | 0.2 |
| Ethanol | 7.0 | 7.0 | 7.0 | 7.0 | 7.0 | 7.0 |
| Potassium toluene sulfonate | 2.0 | 2.0 | 2.0 | 2.0 | 2.0 | 2.0 |
| Hydrogen peroxide | 0.1 | 0.1 | 0.1 | 0.1 | 0.1 | 0.1 |
| Perfume | 0.23 | 0.23 | 0.23 | 0.23 | 0.23 | 0.23 |
| $H_2SO_4$ | ← trim → | | | | | |
| Sodium random n-octadecane phosphonate | 0 | 1 | 2 | 3 | 4 | 5 |
| Water | ← balance → | | | | | |
| pH | 8 | 8 | 8 | 8 | 9 | 8 |

The above compositions were tested as in Example I with the following exception. The soils used were the protein soil, the macaroni and cheese soil and for a third soil, cheddar cheese was used. This soil is prepared by liquifying a can of Campbell's Cheddar Cheese soup in a blender for 60 seconds, and then applying and baking onto the coupons as described above. The results were as follows:

| Composition | 1 | 2 | 3 | 4 | 5 | 6 |
|---|---|---|---|---|---|---|
| Beef Soil | 18 | 10 | 6 | 4 | 3 | 2 |
| Macaroni & Cheese | 32 | 22 | 23 | 18 | 13 | 20 |
| Cheddar Cheese | 20 | 12 | 10 | 9 | 8 | 9 |

The above test was prepared using a Pyrex coupon with the following results.

| Composition | 1 | 2 | 3 | 4 | 5 | 6 |
|---|---|---|---|---|---|---|
| Beef Soil | 14 | 8 | 4 | 3 | 2 | 2 |
| Macaroni & Cheese | 34 | 25 | 25 | 21 | 18 | 21 |
| Cheddar Cheese | 22 | 14 | 12 | 9 | 8 | 11 |

As can be seen, there is a continued improvement with the addition of higher levels.

EXAMPLE III

| | % By Weight | |
|---|---|---|
| | A | B |
| Sodium coconut alkyl sulfate | 11.5 | 11.5 |
| Sodium coconut alkyl polyethoxylate (3) sulfate | 12.5 | 12.5 |
| Coconut alkyldimethylamine oxide | 4 | 4 |
| Sodium citrate | 10 | 10 |
| Ethanol | 3 | 3 |
| Potassium toluene sulfonate | 3 | 3 |
| $H_2O_2$ | 0.01 | 0.01 |
| Perfume | 0.3 | 0.3 |
| Random octadecane phosphonic acid (disodium salt) | 1 | 0 |
| Water | Balance | Balance |
| pH | 8 | 8 |

RESULTS OF TEST

The above compositions were tested on a variety of substrates with the beef soil with the following results. Three cycles of soiling and cleaning are shown with the results given as A/B.

| Substrate | Aluminum | Stainless Steel | Pyrex | Pyro Saram |
|---|---|---|---|---|
| Cycle 1 | 28/32 | 5/13 | 20/30 | 24/29 |
| Cycle 2 | 17/28 | 3/10 | 6/18 | 16/29 |
| Cycle 3 | 14/32 | 2/13 | 7/21 | 12/27 |

These results show a gradual improvement in results across a variety of surfaces.

The compositions provides improved cleaning of hard-to-remove soils from housewares than the equivalent composition without the phosphonic acid. Compositions containing an equivalent of the following materials in place of the citrate also are improved by the phosphonic acid: sodium cyclohexane hexacarboxylate; ammonium cyclopentane tetracarboxylate; potassium tetrahydrofuran tetracarboxylate; monoethanolammonium polyacrylate; diethanolammonium pentane hexacarboxylate; potassium pyrogallol; sodium adipate; sodium gluconate; ammonium mucate; potassium mellitic acid pentacarboxylate; sodium oxylate; ammonium oxydiacetate; sodium malonate; sodium tartrate; and 1:1 mixtures thereof.

EXAMPLE IV

| | % by weight | | | | | | |
|---|---|---|---|---|---|---|---|
| Composition | 1 | 2 | 3 | 4 | 5 | 6 | 7 |
| Sodium $C_{12}$ alkyl benzene sulfonate | 25 | | | 29.3 | | | |
| Sodium $C_{16-18}$ paraffin sulfonate | | 11.5 | | | 13.9 | | 13.4 |
| Sodium $C_{14-16}$ olefin sulfonate | | | 25 | | | 29.3 | |
| Sodium coconut alkyl polyethoxy (3) sulfate | 4 | 12.5 | 3 | 4.7 | 15.1 | 4.7 | 15.1 |
| Coconut isopropanol amide | 4 | 4 | | 4 | 4 | | |
| Coconut diethanol amide | | | 4 | | | 4 | 4 |
| Sodium citrate | 0.1 | 0.1 | 0.1 | 0.1 | 0.1 | 0.1 | 0.1 |
| Ethanol | 7 | 7 | 7 | 7 | 7 | 7 | 7 |
| KCl | 1 | 1 | 1 | 1 | 1 | 1 | 1 |

EXAMPLE IV-continued

| Composition | % by weight | | | | | | |
|---|---|---|---|---|---|---|---|
| | 1 | 2 | 3 | 4 | 5 | 6 | 7 |
| Potassium toluene sulfonate | 3 | 3 | 3 | 3 | 3 | 3 | 3 |
| $H_3O_2$ | 0.01 | 0.01 | 0.01 | 0.01 | 0.01 | 0.01 | 0.01 |
| Potassium $C_{12}$ alkyl benzene polyethoxy (5) phosphate | 1 | | | 5 | | | |
| Potassium $C_{12}$ alkyl benzene phosphonate | | 2 | | | 6 | | |
| Sodium alkyl polyethoxy (4) phosphate | | | 3 | | | 7 | 8 |
| Water and perfume | ← Balance → | | | | | | |

In the above compositions, the specific amides and amine oxides disclosed hereinbefore and 1:1 mixtures thereof can be substituted on an equal weight basis for the amides of this example. Similarly, the specific anionic surfactants and detergency boosting ingredients disclosed hereinbefore and 1:1 mixtures thereof can be substituted on an equal weight basis for the respective anionic surfactants and detergency boosting ingredients of this example.

What is claimed is:

1. A light duty liquid detergent composition consisting essentially of a. from about 5% to about 35% of an anionic surfactant having the formula $[R—(Y)_n—(O)_nSO_2M]$ $R—(Y)_n—(O)_nSO_3M$ wherein R is an alkyl group containing from 8 to about 24 carbon atoms which can be either straight or branched chain, saturated or unsaturated and attached either at the terminal position, a secondary position, or random attachment or mixtures thereof; Y is a group selected from the group consisting of $(OC_2H_4)_x$ wherein $x$ is a number from 1 to 30; $(O—CH_2—CHOH—CH_2)_m$ wherein $m$ is a number from 1 to 3; or a benzene ring; each $n$ is either 0 or 1; and M is selected from the group consisting essentially of sodium; potassium; mono-, di-, or tri-alkanolammonium wherein the alkanol groups contain from 2 to 4 carbon atoms; mono-, di- or tri-alkylammonium wherein the alkyl groups contain from 2 to 4 carbon atoms; ammonium; magnesium; calcium; or mixtures thereof;

b. from 0% to about 15% of a suds boosting ingredient selected from the group consisting of amine oxide surfactants and amide surfactants;

c. from 0.5% to about 10% of a detergency boosting ingredient selected from the group consisting of compounds having the formula

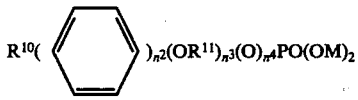

wherein $R^{10}$ is an alkyl group containing from about 14 to about 20 carbon atoms, wherein $R^{11}$ is an alkylene group containing 2 or 3 carbon atoms, wherein $n^2$ is 0 or 1, wherein $n^3$ is a number from 0 to about 20, wherein $n^4$ is 0 or 1, wherein M is a cation selected from the group consisting of hydrogen; sodium; potassium; ammonium; mono-, di-, and tri-alkanolammonium; mono-, di-, and tri-, alkylammonium; magnesium; calcium; and mixtures thereof, $R^{10}$ being a random alkyl group when $n^2$, $n^3$ and $n^4$ are 0;

d. from 0% to heavy metal chelating amounts of citric acid salt; and, e. water, the pH of the composition being above 7 and less than about 10 and said composition being free of effective amounts of detergency builders.

2. The composition of claim 1 wherein the pH of the composition is from about 7.2 to about 9.

3. The composition of claim 1 wherein the anionic surfactant is selected from the group consisting of alkyl sulfates containing $C_8$–$C_{18}$ carbon atoms, alkyl benzene sulfonates in which the alkyl group is a straight or branched chain containing from about 9 to about 15 carbon atoms, alkyl glyceryl ether sulfonates wherein the alkyl group contains from 8 to 18 carbon atoms, sulfuric acid esters of the reaction products of $C_8$–$C_{18}$ carbon atom fatty alcohols with from 1 to 30 moles of ethylene oxide, olefin sulfonate containing from about 12 to about 24 carbon atoms, paraffin sulfonates containing from 8 to 18 carbon atoms and mixtures thereof.

4. The composition of claim 1 wherein the suds booster is selected from the group consisting of tertiary amine oxides, corresponding to the general formula $R^1—(OR^2)_{n'}—N(R^3)_2 \rightarrow O$ in which $R^1$ is an alkyl radical of from about 8 to about 18 carbon atoms; $R^2$ is an alkylene or a hydroxy alkylene group containing 2 to 3 carbon atoms; $n'$ ranges from 0 to 20; and each $R^3$ is selected from the group consisting of methyl, ethyl and hydroxyethyl radicals; organic carboxylic acid amides having the general formula

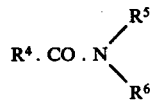

wherein $R^4$ is hydrogen, alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25; and mixtures thereof, the amount of nonionic suds booster being from about 3% to about 7%.

5. The composition of claim 1 wherein the detergency boosting ingredient is selected from a group consisting of random alkyl phosphonates wherein the alkyl group contains from about 14 to about 20 carbon atoms and terminal alkyl phosphates wherein the alkyl group contains from about 14 to about 20 carbon atoms in the form of either sodium; potassium; ammonium; mono-, di-, tri-alkanolammonium; mono-, di-, or tri-alkylammonium; magnesium or calcium salts and mixtures thereof.

6. The composition of claim 5 wherein the pH of the composition is from about 7.2 to about 9.

7. The composition of claim 5 wherein the anionic surfactant is selected from the group consisting of alkyl sulfates of $C_8$–$C_{18}$ carbon atoms, alkyl benzene sulfonates in which the alkyl group is a straight or branched chain containing from about 9 to about 15 carbon atoms, alkyl glyceryl ether sulfonates wherein the alkyl group contains from 8 to 18 carbon atoms, sulfuric acid esters of the reaction products of $C_8$–$C_{18}$ carbon atom fatty alcohols with from 1 to 30 moles of ethylene oxide, olefin sulfonate containing from about 12 to about 24 carbon atoms, paraffin sulfonates containing from 8 to 18 carbon atoms and mixtures thereof.

8. The composition of claim 5 wherein the suds booster is selected from the group consisting of tertiary amine oxides, corresponding to the general formula $$R^1—(OR^2)_{n'}—N(R^3)_2 \rightarrow O$$

in which $R^1$ is an alkyl radical of from about 8 to about 18 carbon atoms; $R^2$ is an alkylene or a hydroxy alkylene group containing 2 to 3 carbon atoms; $n'$ ranges from 0 to 20; and each $R^3$ is selected from the group consisting of methyl, ethyl and hydroxyethyl radicals; organic carboxylic acid amides having the general formula

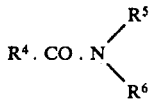

wherein $R^4$ is hydrogen, alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25; and mixtures thereof the amount of nonionic suds booster being from about 3% to about 7%.

9. The process of removing hard to remove soils from housewares including pots, pans, dishes, glasses and utensils using aqueous solutions containing from about 0.1% to about 0.5% of the composition of claim 5.

10. The process of removing hard-to-remove soils from housewares including pots, pans, dishes, glasses and utensils using aqueous solutions containing from about 0.1% to about 0.5% of the composition of claim 1.

11. The process for preparing the composition of claim 1 wherein the detergency boosting ingredient is a phosphonate, said phosphonate being added to the composition at a pH of from about 9 to about 12.5.

* * * * *